US010371436B2

(12) United States Patent
Kumar et al.

(10) Patent No.: US 10,371,436 B2
(45) Date of Patent: Aug. 6, 2019

(54) BIN ASSEMBLY

(71) Applicant: WHIRLPOOL CORPORATION, Benton Harbor, MI (US)

(72) Inventors: Shrawan Kumar, Uttar Pradesh (IN); Kundan S. Rawate, Maharashtra (IN); Lokendra Kumar, Uttar Pradesh (IN); Naushad P. Monangat, Kerla (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/807,117

(22) Filed: Nov. 8, 2017

(65) Prior Publication Data

US 2019/0137168 A1 May 9, 2019

(51) Int. Cl.

| | |
|---|---|
| ***A47B 88/41*** | (2017.01) |
| ***F25D 25/02*** | (2006.01) |
| ***F25D 23/02*** | (2006.01) |

(52) U.S. Cl.

CPC ..... *F25D 25/025* (2013.01); *F25D 23/028* (2013.01); *F25D 2325/021* (2013.01)

(58) Field of Classification Search

CPC .... F25D 25/022; F25D 25/025; F25D 23/028; A47B 88/40; A47B 88/41

USPC .... 312/330.1, 402, 404, 410, 228.1, 334.19, 312/334.21, 334.41, 334.42; 384/19, 21, 384/22, 59

See application file for complete search history.

(56) References Cited

U.S. PATENT DOCUMENTS

| | | | | |
|---|---|---|---|---|
| 774,117 | A | 11/1904 | Tandy | |
| 1,952,148 | A | 3/1934 | Stout | |
| 1,997,432 | A | 4/1935 | Replogle | |
| 2,065,391 | A | 12/1936 | Nance | |
| 2,187,916 | A | 1/1940 | Seeger | |
| 2,225,762 | A | 12/1940 | Barnsteiner | |
| 2,273,918 | A * | 2/1942 | Zalkind | B42F 17/02 312/261 |

(Continued)

FOREIGN PATENT DOCUMENTS

| | | |
|---|---|---|
| BR | PI0100491 B1 | 6/2009 |
| BR | PI0805999 A2 | 6/2010 |

(Continued)

OTHER PUBLICATIONS

GE Appliances, Refrigerator Capacity & Organization: Making Room for More, Jan. 17, 2014, http://www.geappliances.com/appliances/refrigerators/refrigerator-capacity-organize.htm.

(Continued)

*Primary Examiner* — James O Hansen
(74) *Attorney, Agent, or Firm* — Price Heneveld LLP

(57) ABSTRACT

A bin assembly for use within a refrigeration appliance includes a substrate defining a compartment including a central portion, a first lateral portion, and a second lateral portion. A cavity is formed within each lateral portion. A locking member is configured to extend through an opening defined in an exterior wall of each lateral portion. The locking member includes a flange protruding perpendicularly from the locking member. A cover is secured to the locking member and the substrate, and inhibits rotation of the locking member. A rotatable member is coupled to the locking member and configured to move the bin between a stowed position and a deployed position.

20 Claims, 11 Drawing Sheets

(56) References Cited

U.S. PATENT DOCUMENTS 2,282,342 A 5/1942 Preble
2,412,904 A 12/1946 Money et al.
2,434,117 A 1/1948 Money et al.
2,466,360 A 4/1949 Bitney
2,509,592 A 5/1950 Giffard
2,517,385 A 8/1950 Clark
2,573,272 A 10/1951 Petkwitz
2,597,267 A 5/1952 Shoemaker et al.
2,694,906 A 11/1954 Didion
2,710,993 A 6/1955 Kirkpatrick
2,737,782 A 3/1956 Antico
2,742,559 A 4/1956 Edelman
2,748,573 A 6/1956 Staebler et al.
2,773,677 A 12/1956 Hinkel
2,804,068 A 8/1957 Miller et al.
2,841,132 A 7/1958 Philipp
2,875,016 A 2/1959 Fry
3,164,418 A * 1/1965 Biesecker ..... F16B 19/1081 384/19
3,266,858 A 8/1966 Klotz
3,295,904 A 1/1967 Cobb
3,410,260 A 11/1968 Morgan
3,866,437 A 2/1975 Spencer
3,984,163 A 10/1976 Boorman, Jr. et al.
4,595,247 A * 6/1986 Zank ..... A47B 88/487 312/334.19
4,597,616 A 7/1986 Trubiano
4,638,644 A 1/1987 Gidseg
4,729,613 A 3/1988 Tromble et al.
4,732,435 A 3/1988 Bailey et al.
4,735,470 A 4/1988 Falk
4,834,557 A 5/1989 Dreinhoff
4,914,928 A 4/1990 Fellwock et al.
4,998,382 A 3/1991 Kostos et al.
5,040,856 A * 8/1991 Wilkins ..... F25D 25/025 312/334.21
5,088,801 A 2/1992 Rorke et al.
5,273,354 A 12/1993 Herrman et al.
5,362,145 A 11/1994 Bird et al.
5,411,165 A 5/1995 Ellis
5,415,472 A 5/1995 Brise
5,429,043 A 7/1995 Becker
5,447,146 A 9/1995 Nickerson
5,469,999 A 11/1995 Phirippidis
5,524,981 A 6/1996 Herrmann et al.
5,564,809 A 10/1996 Kane et al.
5,605,344 A 2/1997 Insalaco et al.
5,660,777 A 8/1997 Herrmann et al.
5,673,984 A 10/1997 Insalaco et al.
5,735,589 A 4/1998 Herrmann et al.
5,813,741 A 9/1998 Fish et al.
5,833,336 A 11/1998 Dean
5,918,959 A 7/1999 Lee
5,947,573 A 9/1999 Tovar et al.
6,045,101 A 4/2000 Goyette et al.
6,174,482 B1 1/2001 Reames et al.
6,220,684 B1 4/2001 Bent et al.
6,474,094 B2 11/2002 Kim
6,488,347 B1 12/2002 Bienick
6,578,720 B1 6/2003 Wang
6,604,800 B2 8/2003 Hamilton
6,811,045 B1 11/2004 Masker et al.
D505,140 S 5/2005 Reed et al.
D516,100 S 2/2006 Vardon
D516,102 S 2/2006 Vardon
7,021,730 B2 4/2006 Remmers
D523,034 S 6/2006 Vardon
7,059,693 B2 6/2006 Park
D525,633 S 7/2006 Vardon
7,070,249 B2 7/2006 Leimkuehler et al.
7,131,545 B1 11/2006 Grogan
7,178,890 B2 2/2007 Park et al.
7,188,738 B2 3/2007 Stafford et al.
7,232,194 B2 6/2007 Becke et al.
D547,640 S 7/2007 Remmers
D551,262 S 9/2007 Becke
7,270,385 B2 9/2007 Mathur et al.
D551,884 S 10/2007 Remmers
7,367,571 B1 5/2008 Nichols
7,467,834 B2 12/2008 Kim et al.
7,497,533 B2 3/2009 Remmers
7,552,983 B2 6/2009 Shin
7,651,182 B2 1/2010 Eveland et al.
7,726,753 B2 6/2010 Bassi
7,748,569 B2 7/2010 Sunatori
7,748,806 B2 7/2010 Egan
7,878,344 B2 2/2011 Martin et al.
7,976,113 B2 7/2011 Gwak
8,047,397 B2 11/2011 Mittet
D656,970 S 4/2012 Merritt
8,172,347 B2 5/2012 Lim et al.
8,182,056 B2 5/2012 Gossens et al.
8,240,512 B2 8/2012 Sunatori
D669,506 S 10/2012 Czach et al.
8,297,726 B2 10/2012 Ramm et al.
8,336,976 B2 12/2012 Lee
8,345,326 B2 1/2013 Kitagaki et al.
8,348,362 B2 1/2013 Candeo et al.
8,359,881 B2 1/2013 Junge et al.
8,381,949 B2 2/2013 Sunatori
8,403,437 B2 * 3/2013 Bergmann ..... F25D 25/021 312/334.1
8,403,438 B2 3/2013 Park et al.
8,414,095 B2 4/2013 Stewart
8,444,239 B2 5/2013 Gossens et al.
D692,034 S 10/2013 Seo et al.
8,562,089 B2 10/2013 Collins et al.
D694,288 S 11/2013 Hottmann et al.
D694,289 S 11/2013 Hottmann et al.
D694,292 S 11/2013 Eby et al.
8,616,665 B2 12/2013 Czach et al.
8,640,482 B2 2/2014 Lim et al.
8,726,689 B2 5/2014 Jang et al.
8,733,862 B1 5/2014 Armstrong et al.
D707,267 S 6/2014 Choi et al.
8,739,568 B2 6/2014 Allard et al.
D709,927 S 7/2014 Park et al.
8,777,341 B2 7/2014 Amaral et al.
D710,405 S 8/2014 Seo et al.
D710,406 S 8/2014 Seo et al.
D711,943 S 8/2014 Park et al.
8,833,882 B2 9/2014 Seo et al.
D714,840 S 10/2014 Yang et al.
D717,349 S 11/2014 Seo et al.
D719,986 S 12/2014 Kim et al.
8,960,826 B2 2/2015 Choo et al.
9,033,437 B2 5/2015 Klitzing et al.
D734,784 S 7/2015 Kim et al.
9,097,457 B2 8/2015 Kim
9,103,582 B2 8/2015 Nash et al.
9,127,878 B2 9/2015 Gossens et al.
9,131,785 B2 9/2015 Peru
9,151,534 B2 10/2015 Lee et al.
D745,581 S 12/2015 Jeon et al.
9,217,601 B2 12/2015 Koo et al.
D747,369 S 1/2016 McConnell et al.
D747,370 S 1/2016 Kim et al.
D747,371 S 1/2016 Lee et al.
D747,372 S 1/2016 Kim et al.
D747,373 S 1/2016 Lee et al.
D748,165 S 1/2016 McConnell et al.
9,234,690 B2 1/2016 McCollugh et al.
9,250,010 B2 2/2016 De La Garza et al.
9,297,573 B2 3/2016 Krause et al.
D754,759 S 4/2016 McConnell et al.
9,320,368 B2 4/2016 Marotti et al.
9,328,955 B2 5/2016 Castro Solis et al.
9,339,993 B2 5/2016 Cites et al.
D761,884 S 7/2016 Austin et al.
9,488,405 B2 11/2016 Lee et al.
9,500,403 B2 11/2016 Seo et al.
9,510,679 B2 12/2016 Bhatt et al.
9,671,115 B2 6/2017 Elkasevic
9,823,013 B1 11/2017 Caglin et al.

(56) References Cited

U.S. PATENT DOCUMENTS

| | | | |
|---|---|---|---|
| 9,861,200 | B2 | 1/2018 | Lim |
| 9,945,601 | B1 | 4/2018 | Bhavsar et al. |
| 2003/0020387 | A1 | 1/2003 | Wing et al. |
| 2004/0012314 | A1 | 1/2004 | Hay et al. |
| 2004/0104323 | A1 | 6/2004 | Hubert et al. |
| 2005/0073225 | A1 | 4/2005 | Kwon et al. |
| 2006/0042305 | A1 | 3/2006 | Oh et al. |
| 2006/0049731 | A1 | 3/2006 | Choi et al. |
| 2006/0145577 | A1 | 7/2006 | Daley et al. |
| 2006/0226749 | A1 | 10/2006 | Kim |
| 2006/0226751 | A1 | 10/2006 | Park |
| 2007/0126325 | A1 | 6/2007 | Gorz et al. |
| 2008/0203041 | A1 | 8/2008 | Lim et al. |
| 2008/0315743 | A1 | 12/2008 | Oh |
| 2009/0193836 | A1 | 8/2009 | Ertz et al. |
| 2010/0024464 | A1 | 2/2010 | Hwang et al. |
| 2010/0102693 | A1 | 4/2010 | Driver et al. |
| 2010/0109498 | A1 | 5/2010 | Ramm et al. |
| 2010/0219731 | A1 | 9/2010 | Canoe et al. |
| 2011/0001415 | A1 | 1/2011 | Park et al. |
| 2011/0072846 | A1 | 3/2011 | Engel et al. |
| 2011/0115356 | A1 | 5/2011 | Nash et al. |
| 2012/0018434 | A1 | 1/2012 | Gwak |
| 2012/0024006 | A1 | 2/2012 | Knoll et al. |
| 2012/0091084 | A1 | 4/2012 | Amaral et al. |
| 2012/0222267 | A1 | 9/2012 | Desrosiers et al. |
| 2012/0223038 | A1 | 9/2012 | Bean |
| 2012/0248958 | A1 | 10/2012 | Ertz et al. |
| 2013/0020922 | A1 | 1/2013 | Jang |
| 2013/0219731 | A1 | 8/2013 | Zhang |
| 2014/0217044 | A1 | 8/2014 | Cole |
| 2015/0034668 | A1 | 2/2015 | Minard et al. |
| 2015/0061484 | A1 | 3/2015 | Jeong et al. |
| 2015/0068999 | A1 | 3/2015 | Dart et al. |
| 2015/0107084 | A1 | 4/2015 | Craycraft et al. |
| 2015/0168048 | A1 | 6/2015 | Sexton et al. |
| 2015/0184929 | A1 | 7/2015 | Moon |
| 2015/0351532 | A1 | 12/2015 | Peru |
| 2016/0067863 | A1 | 3/2016 | Cole |
| 2016/0290707 | A1 | 10/2016 | Burke et al. |
| 2017/0086580 | A1 | 3/2017 | Conti |
| 2017/0181538 | A1 | 6/2017 | Azkue et al. |
| 2017/0276425 | A1 | 9/2017 | Fink et al. |
| 2017/0341217 | A1 | 11/2017 | Cole |
| 2018/0127007 | A1 | 5/2018 | Kravchenko |

FOREIGN PATENT DOCUMENTS

| | | | |
|---|---|---|---|
| CN | 101611281 | A | 12/2009 |
| CN | 201779952 | U | 3/2011 |
| CN | 102135363 | A | 7/2011 |
| CN | 202126135 | U | 1/2012 |
| CN | 102395849 | A | 3/2012 |
| CN | 102494496 | A | 6/2012 |
| CN | 202432813 | U | 9/2012 |
| CN | 102829604 | A | 12/2012 |
| CN | 102889744 | A | 1/2013 |
| CN | 101688748 | B | 12/2013 |
| CN | 104089457 | A | 10/2014 |
| CN | 205619680 | U | 10/2016 |
| CN | 205641793 | U | 10/2016 |
| CN | 205980510 | U | 2/2017 |
| DE | 8801508 | U1 | 6/1989 |
| DE | 700820 | T1 | 11/1996 |
| DE | 69519613 | T2 | 4/2001 |
| DE | 10107646 | A1 | 8/2002 |
| DE | 69529852 | T2 | 9/2003 |
| DE | 102009045363 | A1 | 4/2011 |
| DE | 102013216974 | A1 | 4/2014 |
| DE | 102012223131 | A1 | 6/2014 |
| EP | 0577939 | A1 | 1/1994 |
| EP | 700820 | A2 | 3/1996 |
| EP | 579364 | B1 | 12/1997 |
| EP | 940316 | A2 | 9/1999 |
| EP | 1790250 | A2 | 5/2007 |
| EP | 1349802 | B1 | 8/2008 |
| EP | 1985205 | A1 | 10/2008 |
| EP | 2072937 | A2 | 6/2009 |
| EP | 2098810 | A2 | 9/2009 |
| EP | 2424421 | B1 | 10/2015 |
| EP | 2760315 | B1 | 8/2016 |
| EP | 2926069 | B1 | 11/2016 |
| EP | 3327390 | A1 | 5/2018 |
| ES | 2327831 | T3 | 11/2009 |
| IN | 201737009466 | | 8/2017 |
| JP | H10115485 | A | 5/1998 |
| JP | H10122733 | A | 5/1998 |
| JP | H11237173 | A | 8/1999 |
| JP | 2002090054 | A | 3/2002 |
| KR | 100364994 | B1 | 12/2002 |
| KR | 374557 | B1 | 3/2003 |
| KR | 20030061668 | A | 7/2003 |
| KR | 100431346 | B1 | 5/2004 |
| KR | 1020040070986 | | 8/2004 |
| KR | 20040095421 | A | 11/2004 |
| KR | 100559722 | B1 | 3/2006 |
| KR | 100756887 | B1 | 9/2007 |
| KR | 850005 | B1 | 8/2008 |
| KR | 2010026614 | A | 3/2010 |
| KR | 20100023474 | A | 3/2010 |
| KR | 20140022598 | A | 2/2014 |
| KR | 20140088376 | A | 7/2014 |
| KR | 2017043815 | A | 4/2017 |
| KR | 20170065775 | A | 6/2017 |
| WO | 02014761 | A1 | 2/2002 |
| WO | 2004104504 | A1 | 12/2004 |
| WO | 2005012812 | A1 | 2/2005 |
| WO | 2007128734 | A1 | 11/2007 |
| WO | 2008015180 | A2 | 2/2008 |
| WO | 2009155679 | A2 | 12/2009 |
| WO | 2011009773 | A2 | 1/2011 |
| WO | 2011080109 | A2 | 7/2011 |
| WO | 2012025382 | A2 | 3/2012 |
| WO | 2012062670 | A2 | 5/2012 |
| WO | 2013126515 | A1 | 8/2013 |
| WO | 2015101430 | A1 | 7/2015 |
| WO | 2015101434 | A1 | 7/2015 |
| WO | 2015149832 | A1 | 10/2015 |
| WO | 2015165531 | A1 | 11/2015 |
| WO | 2016155784 | A1 | 10/2016 |
| WO | 2017005314 | A1 | 1/2017 |

OTHER PUBLICATIONS

GE Appliances, GE Profile Side by Side Refrigerators, Jan. 17, 2014, http://www.abt.com/ge/GE_Profile_SideBySide.

* cited by examiner

BIN ASSEMBLY

FIELD OF THE DISCLOSURE

The present disclosure generally relates to a bin assembly. More specifically, the present disclosure relates to a roller assembly for the bin assembly that may be used inside a refrigerator.

BACKGROUND

Currently bin assemblies include roller assemblies mounted to the side of the assemblies using an axle configured to screw directly into the side of the bin assembly. It is desired to create a more robust bin assembly.

SUMMARY

According to a first aspect of the present disclosure, a bin assembly comprises a substrate defining a compartment. The compartment includes a central portion, a first lateral portion, and a second lateral portion, and a cavity is formed within each lateral portion. A locking member is configured to extend through an opening defined in an exterior wall of each lateral portion. The locking member includes a flange protruding perpendicularly from the locking member. A cover is secured to the locking member and the substrate to inhibit rotation of the locking member. A rotatable member is coupled to the locking member and is configured to move the bin assembly between a stowed position and a deployed position.

According to a second aspect of the present disclosure, a bin assembly comprises a substrate having a bottom surface and a perimeter wall defining a compartment with a front portion and a back portion. The substrate further defines a cavity and an opening. The bin assembly further comprises a locking member with a center portion and two protrusions. The two protrusions extend in opposing directions from the center portion, and a flange extends from the locking member and is oriented perpendicularly to the center portion. A cover further secures the locking member and the two protrusions to prevent the locking member from rotating. A wheel is operably coupled to an aperture defined by the locking member.

According to a third aspect of the present disclosure, a bin assembly comprises a substrate defining a compartment and a cavity external to the compartment. A locking member is disposed within an opening defined by an exterior wall of the cavity, and a flange extends from the locking member. A cover is coupled with the locking member on an opposing side of the substrate from the flange, and a rotatable member is operably coupled with an aperture defined by the cover, the locking member, and the exterior wall of the cavity.

These and other aspects, objects, and features of the present disclosure will be understood and appreciated by those skilled in the art upon studying the following specification, claims, and appended drawings.

DETAILED DESCRIPTION

Figure 1:
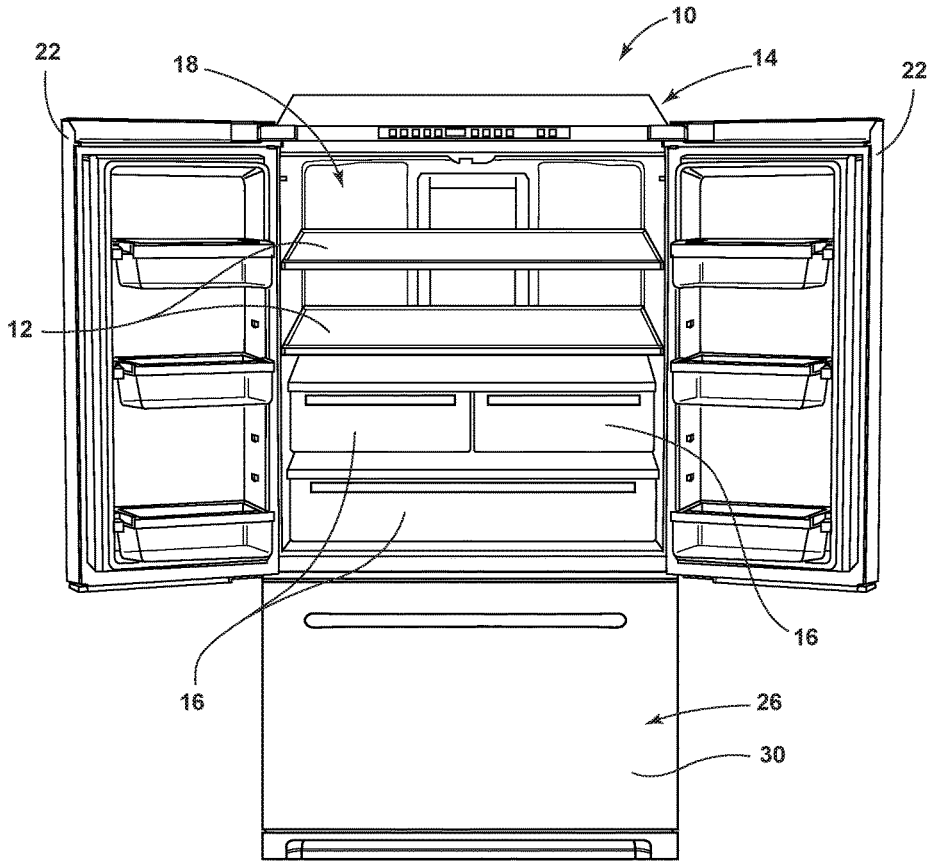
FIG. 1 is a front perspective view of a refrigeration appliance according to one aspect.

For purposes of description herein, the terms "upper," "lower," "right," "left," "rear," "front," "vertical," "horizontal," and derivatives thereof shall relate to the concepts as oriented in FIG. 1. However, it is to be understood that the concepts may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The present illustrated embodiments reside primarily in combinations of method steps and apparatus components related to a roller assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

As used herein, the term "and/or," when used in a list of two or more items, means that any one of the listed items can be employed by itself, or any combination of two or more of the listed items, can be employed. For example, if a composition is described as containing components A, B, and/or C, the composition can contain A alone; B alone; C alone; A and B in combination; A and C in combination; B and C in combination; or A, B, and C in combination.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

By way of illustration, FIGS. 1-8 provide exemplary features, aspects, and embodiments for a bin assembly 16 located within a refrigeration appliance 10 including a cabinet 14. The cabinet 14 may include storage shelves 12 and bin assemblies 16. The bin assemblies 16 may be comprised of a substrate 32 defining a compartment 34 including a central portion 84, a first lateral portion 76, and a second lateral portion 80. A cavity 78, 82 is formed within each lateral portion 76, 80, and each cavity 78, 82 houses a locking member 200. The locking member 200 includes a flange 204 protruding perpendicularly from the locking member 200. The locking member 200 is configured to extend through an opening 100 defined in an exterior wall 98 of each lateral portion 76, 80. Also included in the bin assembly 16 is a cover 300 secured to the locking member 200 and the exterior wall 98 to prevent undesired rotation of the locking member 200. A rotatable member 400 is also coupled to the locking member 200 and is configured to move the bin assembly 16 between a stowed position and a deployed position.

Referring now to FIG. 1, the numeral 10 generally denotes a refrigeration appliance including a cabinet 14 that defines a refrigeration chamber 18 selectively closeable by a pair of refrigeration chamber doors 22 and a freezer chamber 26 selectively closeable by a freezer chamber door 30. The refrigeration chamber 18 and the freezer chamber 26 act as storage compartments within the cabinet 14. Included within the refrigeration chamber 18 and the freezer chamber 26 may be storage shelves 12 and bin assemblies 16. The bin assemblies 16 may act as drawers for a variety of purposes including, for example, a crisper drawer. In FIG. 1, a French door bottom-mount refrigeration appliance 10 is shown where the freezer chamber 26 is located below the refrigeration chamber 18. Although one particular design of the refrigeration appliance 10 is shown in FIG. 1, other refrigerator styles and configurations are contemplated. For example, the refrigeration appliance 10 could be a side-by-side refrigeration appliance, a refrigeration appliance with the freezer chamber positioned above the refrigeration chamber (top-mount refrigeration), a refrigeration appliance that includes only a refrigeration chamber and no freezer chamber, etc.

Figure 2:
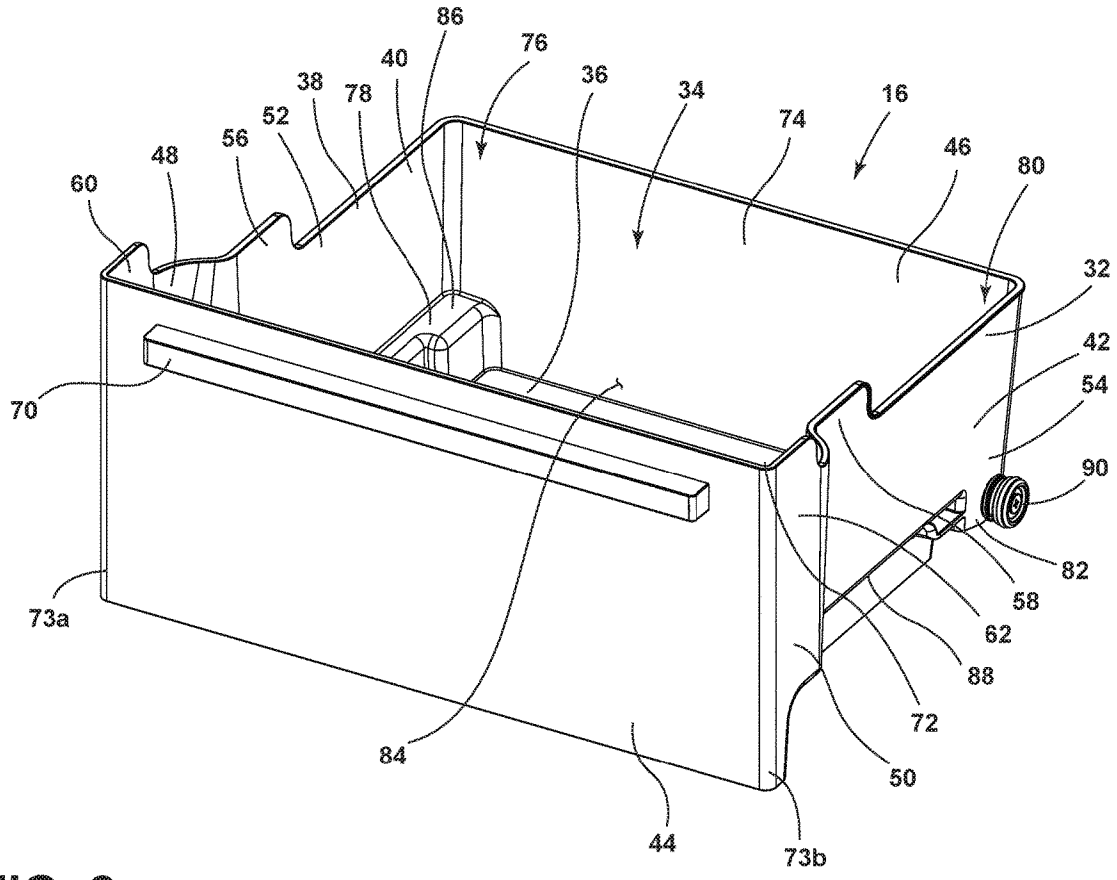
FIG. 2 is a side perspective view of a bin assembly with a wheel assembly.

Referring now to FIG. 2, the bin assembly 16 is shown having a substrate 32 defining the compartment 34. The compartment includes a bottom surface 36 and two spaced-apart sidewalls 40, 42 joined together by a front wall 44 and a back wall 46. Together, the sidewalls 40, 42, the front wall 44, and the back wall 46 define a compartment perimeter wall 38. The bottom surface 36 and the compartment perimeter wall 38 may be integrally formed. Each sidewall 40, 42 includes a forward sidewall 48, 50 and a rear sidewall 52, 54. The rear sidewall 52, 54 is of a first height. The forward sidewall 48, 50 extends upward from the rear sidewall 52, 54 to form a first step 56, 58 of a second height. The forward sidewall 48, 50 may extend again upward from the first step 56, 58 to form a second step 60, 62 of a third height. The second steps 60, 62 are of the same third height as and may be integrally formed with the front wall 44. Similarly, the rear sidewalls 52, 54 may be integrally formed with and are of the same first height as the back wall 46.

Still referring to FIG. 2, a handle 70 is disposed on the front wall 44 and is configured to aid in moving the bin assembly 16 between the stowed position and the deployed position. In the stowed position, the bin assembly 16 may be disposed within the refrigeration chamber 18. In the deployed position, the bin assembly 16 may be disposed outwardly of the refrigeration chamber 18. While the handle 70 in the embodiment shown is a finger pull, the handle 70 may be any feature useful for opening and closing a drawer such as, for example, a knob, bar handle, T-bar handle, recessed handle, appliance pull, bail pull, or flush pull.

Referring again to FIG. 2, the compartment 34 is also subdivided into a front portion 72 and a back portion 74. The front portion 72 includes two laterally extending spaces 73*a*, 73*b* that extend outward to conceal the back portion 74 when the bin assembly 16 is viewed from the front. The back portion 74 can also be divided into a first lateral portion 76, a second lateral portion 80 and a central portion 84. The first and second lateral portions 76, 80 may each include a stepped surface 86, 88 that provides space for a track member to be used with the bin assembly 16 if desired. It will be appreciated that the bin assembly may not include such a stepped surface and that the overall shape of the compartment may vary depending on the application of the bin assembly. These lateral portions 76, 80 are also hidden from view by the front portion 72 when the bin assembly 16 is viewed from the front. Included in these lateral portions 76, 80 are cavities 78, 82 each having an exterior wall 98 defining an opening 100. A roller assembly 90 is operably coupled to each opening 100 such that the roller assemblies 90 are hidden from view by the laterally extending spaces 73*a*, 73*b* when the bin assembly 16 is viewed from the front, as shown in FIGS. 2 and 3.

Figure 3:
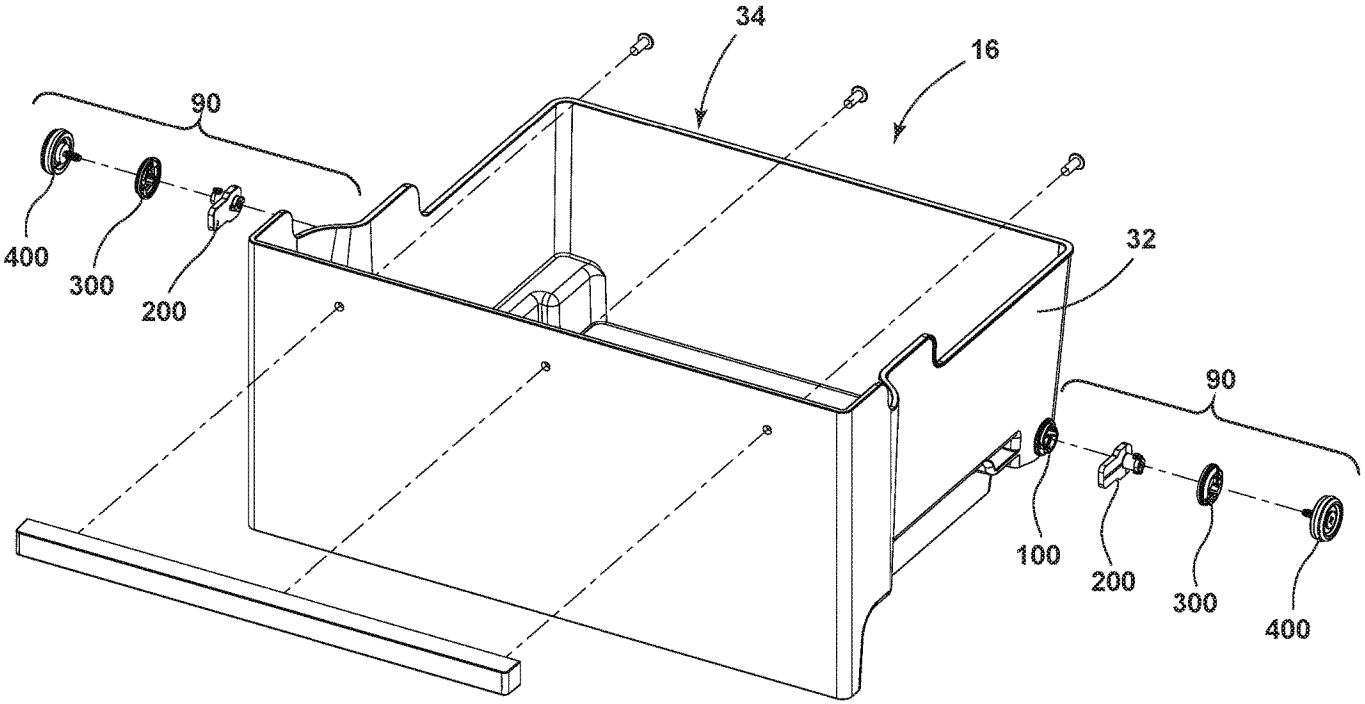
FIG. 3 is an exploded view of the wheel assembly and the bin assembly.

Referring now to FIG. 3, the bin assembly 16 is shown with a roller assembly 90 exploded away from the compartment 34. The roller assembly 90 includes the locking member 200, the cover 300, and the rotatable member 400. The roller assembly 90 is operably coupled to the opening 100 defined by the exterior wall 98 of the lateral portions 76, 80.

Figure 4A:
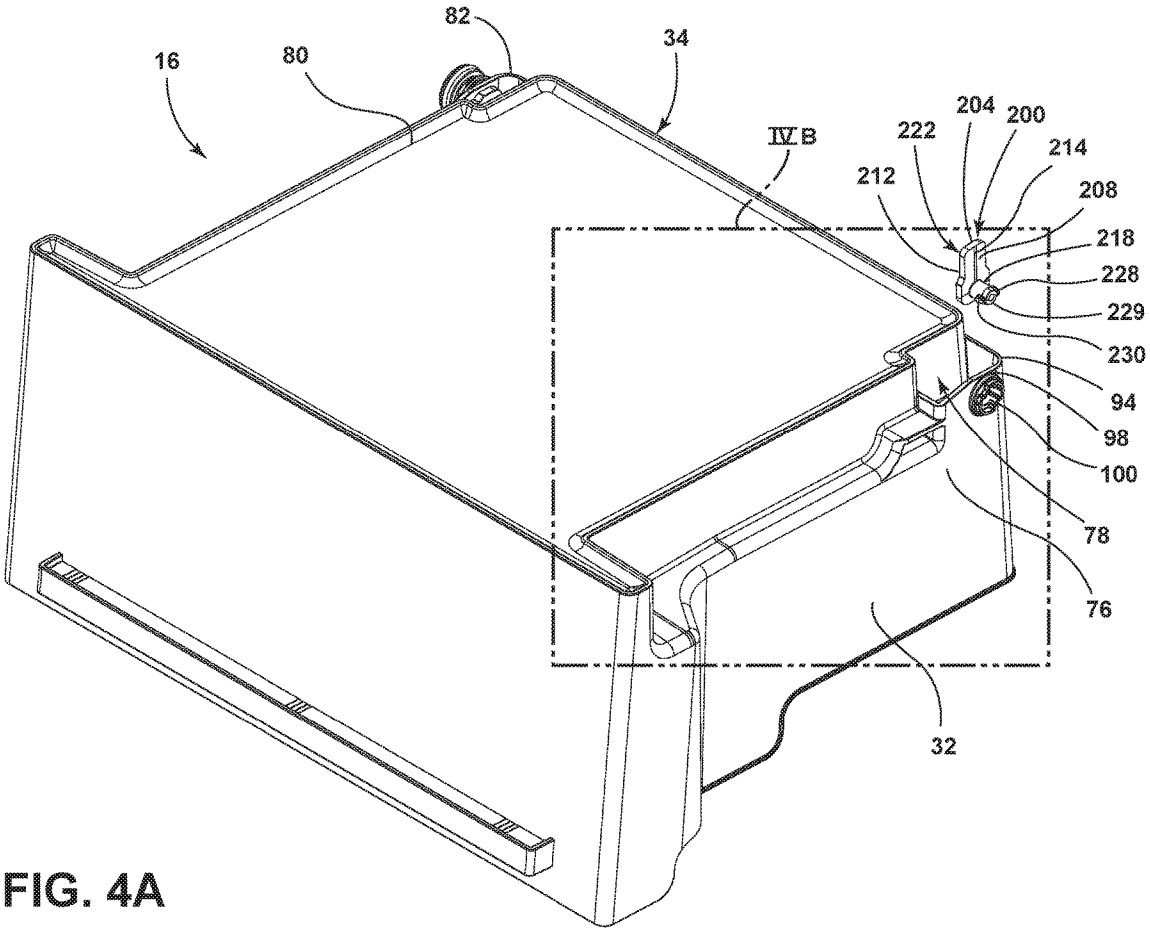
FIG. 4A is a bottom perspective view of the bin assembly with a locking member.
Figure 4B:
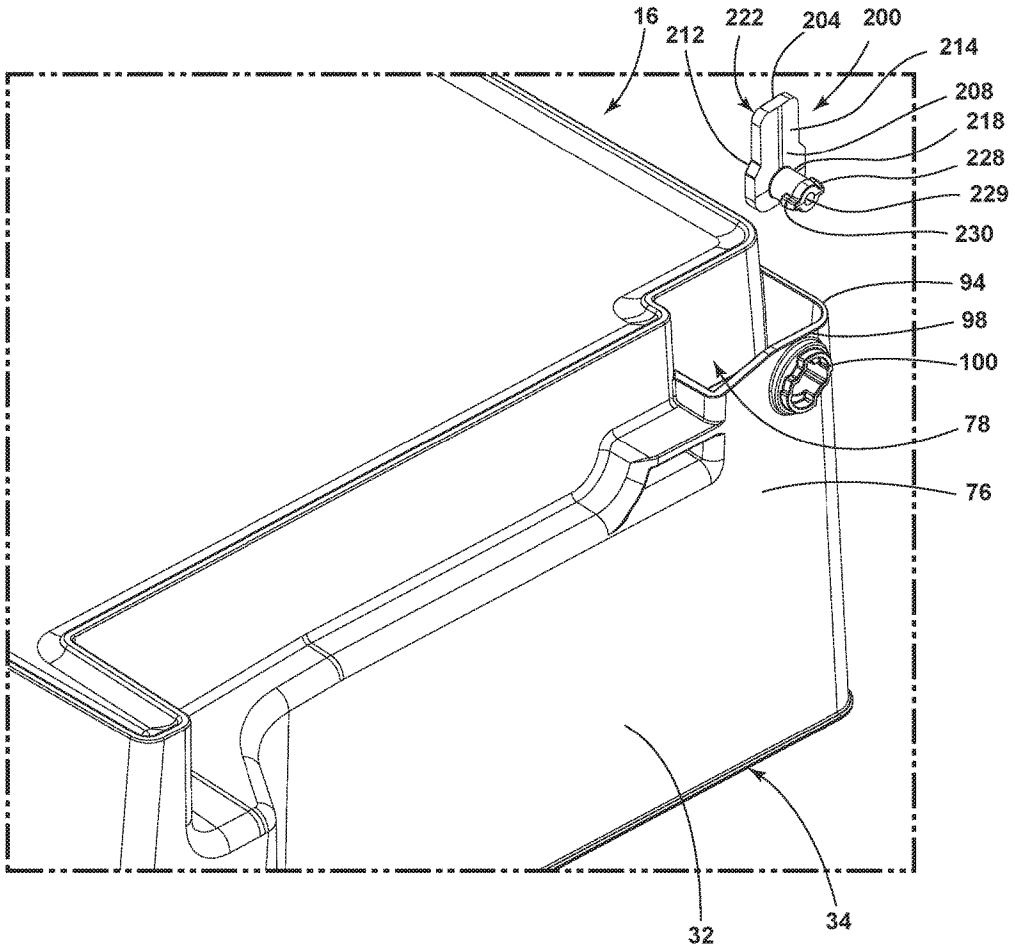
FIG. 4B is an enhanced view of the locking member as shown in FIG. 4A.

Referring now to FIGS. 4A and 4B, the bin assembly 16 is shown with cavities 78, 82 defined by the substrate 32 external to the compartment 34 and disposed within the lateral portions 76, 80. Each cavity has a perimeter wall 94 with an exterior wall 98. The exterior wall 98 defines an opening 100. Each cavity 78, 82 may house the locking member 200. The locking member 200 includes a flange 204 having a front surface 208 and a back surface 212. The flange 204 is integrally formed with the locking member 200 such that the locking member 200 extends perpendicularly through the flange 204. The flange 204 includes a first portion 214 and a second portion 218. The first portion 214 may be narrower than the second portion 218, creating a handle 222 for moving the locking member 200. The second portion 218 also extends past the locking member 200 to protrude from the opposite side of the locking member 200.

Still referring to FIGS. 4A and 4B, the locking member 200, as shown, has a cylindrical center portion 229 and includes first and second protrusions 228, 230, as best seen in FIG. 4B. The center portion 229 and the first and second protrusions 228, 230 are configured to extend through the opening 100. It will be appreciated that the center portion 229 may be of any geometry without departing from the scope of the present disclosure. The protrusions 228, 230 extend in opposing directions from the cylindrical center portion 229.

Figure 5A:
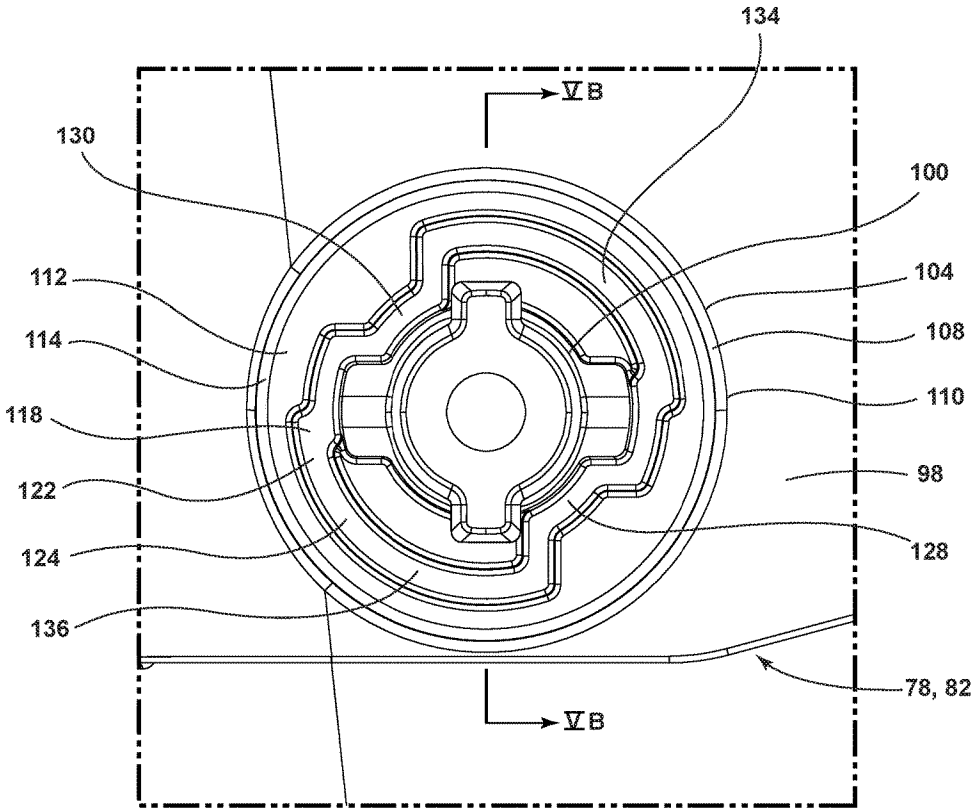
FIG. 5A is a side enhanced elevational view of the opening and the locking member.
Figure 5B:
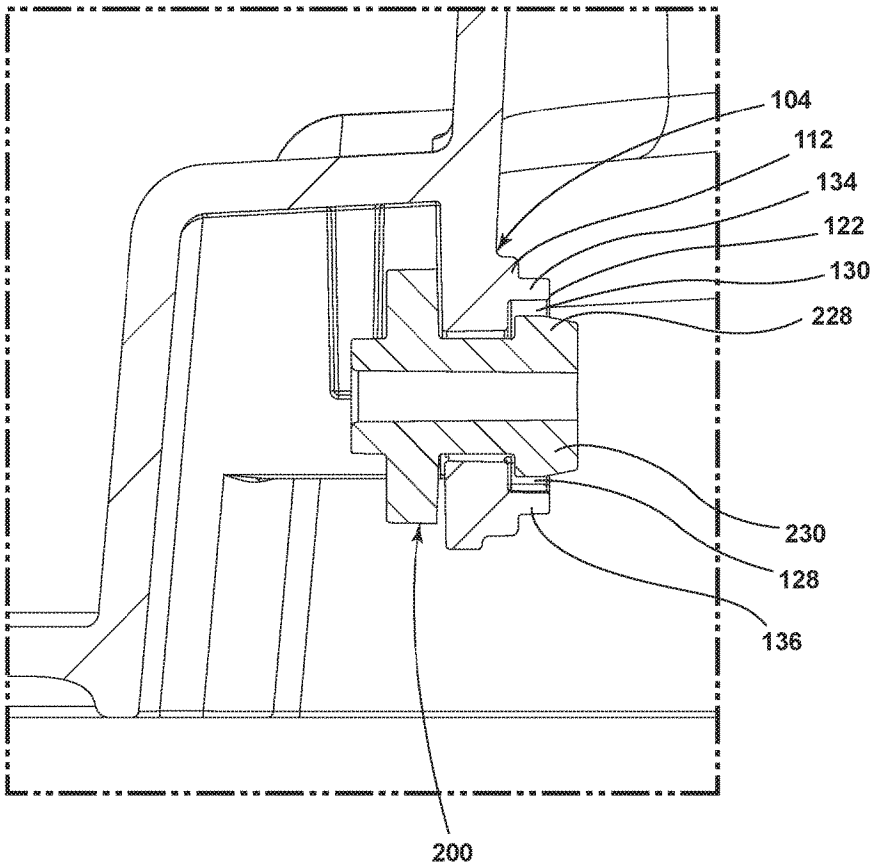
FIG. 5B is a cross-sectional view of the wheel assembly taken along the line VB-VB of FIG. 5A.

As best shown in FIG. 5A, the opening 100 includes a rim 104 that surrounds the opening 100. The rim 104 consists of a first raised portion 108. The first raised portion 108 includes a first outer lip 110 that sits flush with the exterior wall 98 of the cavity 78, 82. The first raised portion 108 is configured to align with the shape of the locking member 200 to allow the locking member 200 to pass through the opening 100 when the locking member is in a first position. A second raised portion 112 extends from the first raised portion 108 and forms a second outer lip 114. The second raised portion 112 may be smaller in surface area than the first raised portion 108 and may also frame the opening 100 in the same way the first raised portion 108 does. An extension 118 is integrally formed with the second raised portion 112 and defines a perimeter wall 122 with a top surface 124. In this embodiment, the perimeter wall 122 is in the shape of a circle with two indentions 128, 130 configured to divide the circle into two arcs 134, 136. Each arc 134, 136 begins and ends at one wall of the indentions 128, 130 of the perimeter wall 122 and extends to the opposite wall of the other indention 128, 130. Together, the indentions 128, 130 and the arcs 134, 136 form a contact surface that defines a predefined magnitude of rotation for the locking member in a first direction when disposed within the opening As shown in FIG. 5B, the protrusions 228, 230 may have a thickness greater than the distance from the second raised portion 112 of the rim 104 to the perimeter wall 122 that allow the locking member 200 to protrude past the rim 104 when coupled to the opening 100. This allows the protrusions 228, 230 of the locking member 200 to rotate a predefined distance around the arcs 134, 136 before being stopped by one of the indentions 128, 130 of the perimeter wall 122 and also allows the cover 300 to connect to the locking member 200.

Figure 6A:
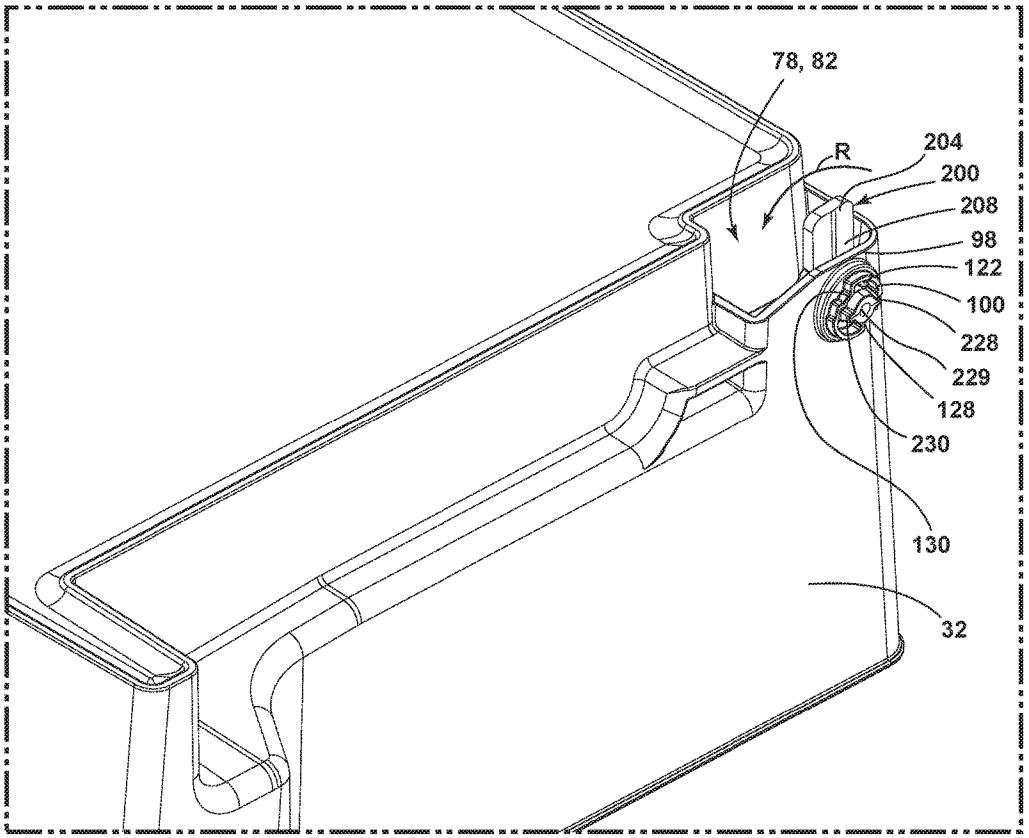
FIG. 6A is an enhanced view of the locking member shown in FIG. 4A with the locking member in a first position.

Referring now to FIG. 6A, the locking member 200 is shown within the opening 100 and in a first position. The cylindrical center portion 229 and the protrusions 228, 230 are disposed in the opening 100 and may be framed by the perimeter wall 122. In this first position, the protrusions 228, 230 are oriented horizontally and may be flush against, or contact, a first side of the indentions 128, 130 of the perimeter wall 122. The flange 204 may be oriented vertically, and the locking member 200 is set within the opening 100 so that the front surface 208 of the flange 204 may sit along the substrate 32 forming the exterior wall 98 of the cavity 78, 82. The locking member 200 can be rotated in a first direction along arrow R from the first position to a second position. The indentions 128, 130 prevent the locking member 200 from rotating beyond the second position.

Figure 6B:
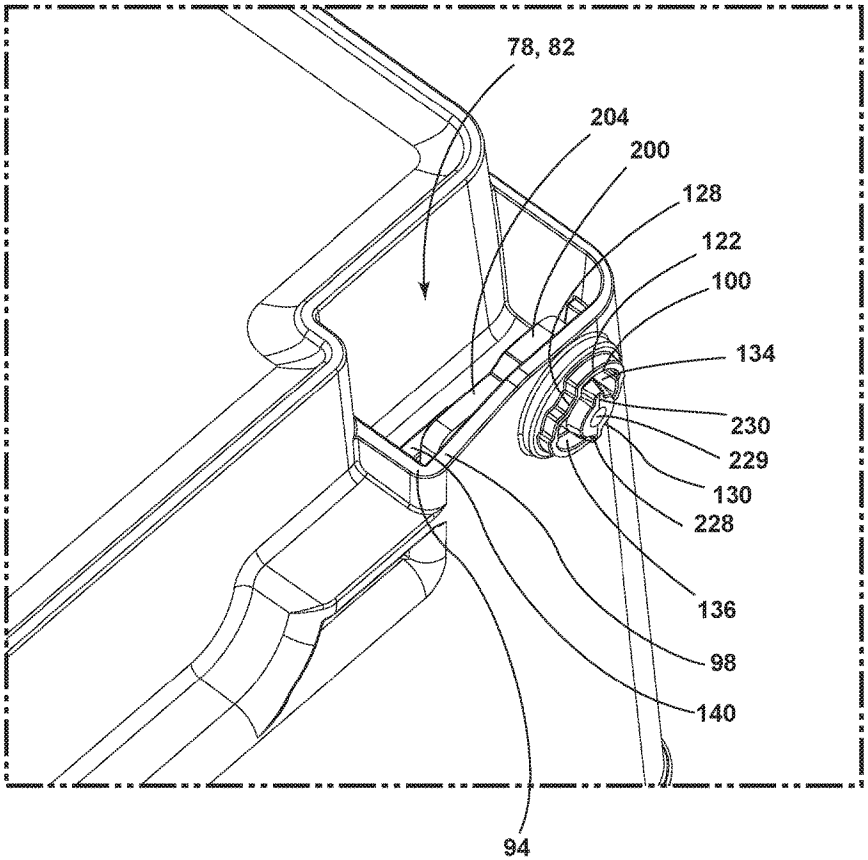
FIG. 6B is an enhanced view of the locking member shown in FIG. 4A with the locking member in a second position.

Referring now to FIG. 6B, the locking member 200 is shown coupled with the opening 100 and rotated to a second position so that the protrusions 228, 230 have rotated from sitting horizontally aligned with a first indention 128, 130 to sitting vertically aligned with a second indention 128, 130 on the opposite side of the arc 134, 136. The flange 204 is oriented horizontally within the cavity 78, 82 in the second position and is configured to sit between a dividing wall 140 and the exterior wall 98. The dividing wall 140 is disposed within the cavity 78, 82 and is configured to extend from the perimeter wall 94 of the cavity 78, 82.

Figure 7:
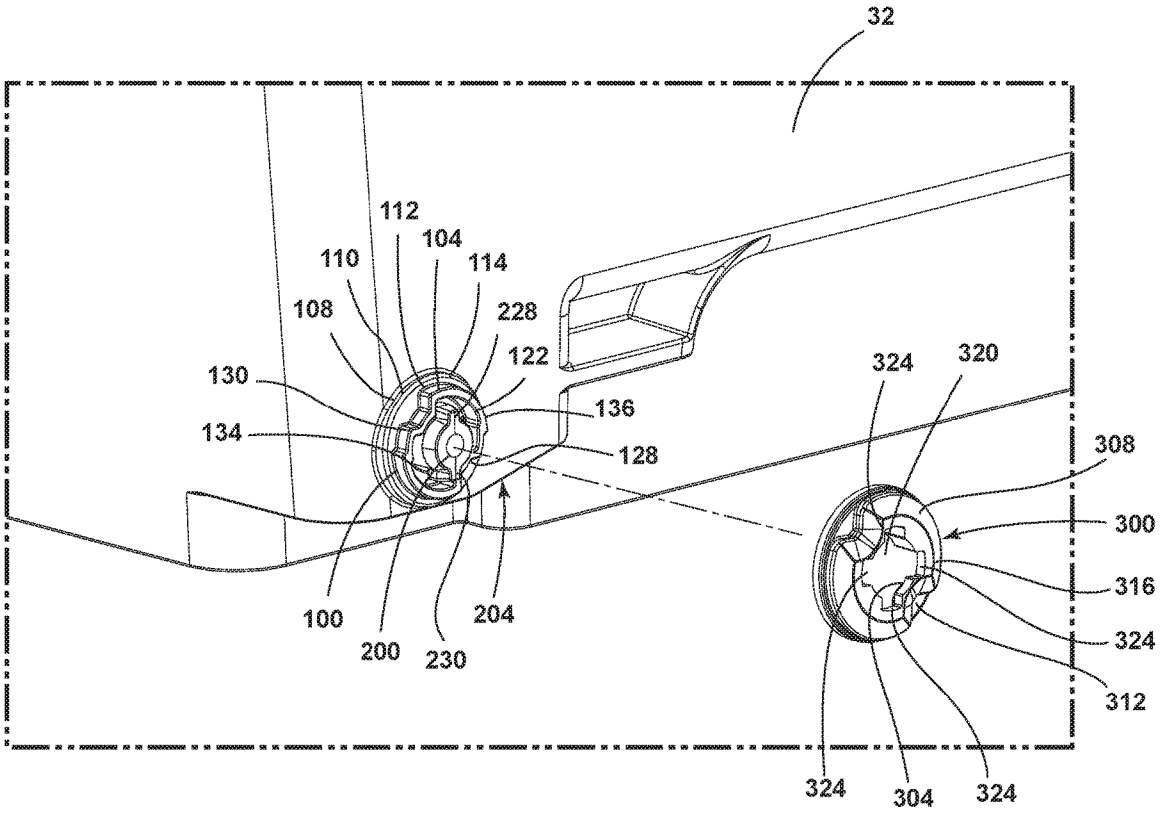
FIG. 7 is a side perspective view of the locking member with a cover separated from the locking member.

Referring now to FIG. 7, the locking member 200 is shown coupled to the opening 100 in the second position. A cover 300 is also shown separated from the locking member 200 and the opening 100. The cover 300 is configured to engage with the rim 104 of the opening 100 on an opposing side of the substrate 32 from the flange 204. In some examples, the cover 300 is circular to mimic the shape of the rim 104. An inner portion 304 of the cover 300 is configured to couple with the first raised portion 108, the first outer lip 110, the second raised portion 112, and/or the second outer lip 114 of the opening 100. As illustrated, the cover 300 may be shaped to couple with the substrate 32 around the opening 100, and may be of any shape or dimension.

Referring still to FIG. 7, the cover 300 includes the inner portion 304 and an outer portion 308. The cover 300 also includes a first portion 312 and a second portion 316 with the second portion 316 being raised from the first portion 312. The first portion 312 couples with the substrate 32 and the rim 104 while the second portion 316 couples with the perimeter wall 122. The second portion 316 may be configured to cover or surround the perimeter wall 122, and/or cover the arcs 134, 136 and/or the indentions 128, 130. The second portion 316 also defines an opening 320 that receives the locking member 200. The opening 320 includes spaces 324 to receive the protrusions 228, 230 in the second position. When the cover 300 is coupled to the locking member 200 and the substrate 32, the cover 300 inhibits rotation of the locking member in a second direction, which is opposite the first direction indicated by arrow R as seen in FIG. 6A.

Figure 8:
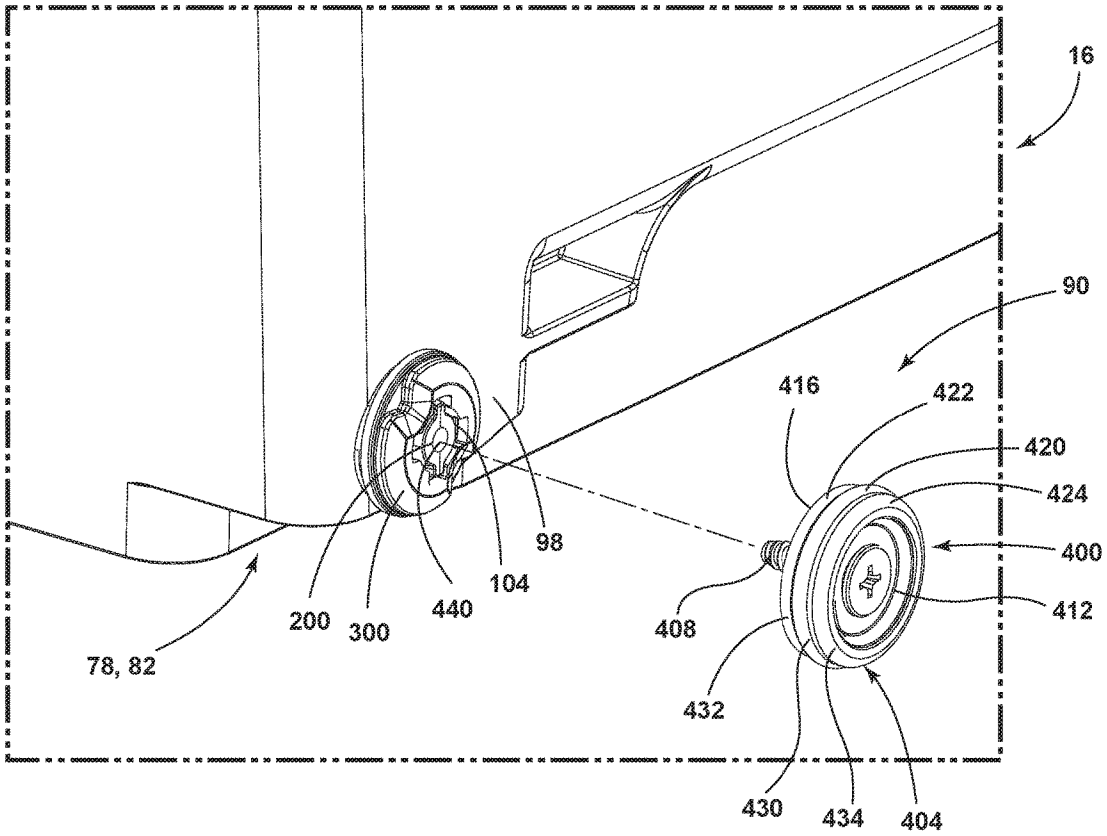
FIG. 8 is a side perspective view of the locking member and the cover with a wheel separated from the locking member.

Referring now to FIG. 8, the roller assembly 90 is shown with the cover 300 maintaining the locking member 200 in place in the second position. Separated from the roller assembly 90 is a rotatable member 400. The rotatable member 400, in the embodiment shown, includes a wheel 404 operably coupled with an axle 408. The axle 408, in turn, operably couples the wheel 404 to the locking member 200. Alternatively, the wheel 404 may be integrally formed with the axle 408. The axle 408 couples with an aperture 440 that is defined by the cover 300, the locking member 200, the rim 104, and the exterior wall 98 of the cavity 78, 82 to allow the wheel 404 to rotate. The axle 408 may be coupled to the locking member 200 in any way known in the art, including, for example, having the axle 408 threaded or otherwise releasably or fixably retained to the locking member 200 or having the axle 408 integrally formed with the locking member 200. The wheel 404 includes an outer surface 412 and an inner surface 416. The axle 408 extends from the inner surface 416 and is oriented perpendicularly to the wheel 404 along the axis of rotation of the wheel 404. The wheel 404 also includes a center wheel portion 420 and two lateral wheel portions 422, 424 on either side of the center wheel portion 420. The center wheel portion 420 and the lateral wheel portions 422, 424 include rolling surfaces 430, 432, 434 to allow the wheel 404 to move forward or backward as the wheel 404 rotates.

Referring still to FIG. 8, the wheel 404, in the present embodiment, is independent from the rest of the refrigeration appliance 10 and is coupled to the bin assembly 16. However, it is contemplated that the bin assembly could be coupled to a track member for easier movement between the stowed position and the deployed position. The track member may be of any practicable design.

Use of the bin assembly may provide various advantages. For example, it may prevent various problems such as breaking the pan when screwing the axle into the bin assembly, causing a failure of the pan boss area while screwing in or testing the roller assembly, or creating a chock hazard because of failure at the pan boss location. It may also increase pan reliability as the roller assembly no longer directly touches the part, reducing the wear and tear on both pieces.

Modifications of the disclosure will occur to those skilled in the art and to those who make or use the concepts disclosed herein. Therefore, it is understood that the embodiments shown in the drawings and described above are merely for illustrative purposes and not intended to limit the scope of the disclosure, which is defined by the following claims as interpreted according to the principles of patent law, including the doctrine of equivalents.

It will be understood by one having ordinary skill in the art that construction of the described concepts, and other components, is not limited to any specific material. Other exemplary embodiments of the concepts disclosed herein may be formed from a wide variety of materials, unless described otherwise herein.

For purposes of this disclosure, the term "coupled" (in all of its forms: couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature, or may be removable or releasable in nature, unless otherwise stated.

It is also important to note that the construction and arrangement of the elements of the disclosure, as shown in the exemplary embodiments, is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts, or elements shown as multiple parts may be integrally formed, the operation of the interfaces may be reversed or otherwise varied, the length or width of the structures and/or members or connectors or other elements of the system may be varied, and the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes, or steps within described processes, may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further, it is to be understood that such concepts are intended to be covered by the following claims, unless these claims, by their language, expressly state otherwise.

What is claimed is:

1. A bin assembly comprising:

a substrate defining a compartment including a central portion, a first lateral portion, and a second lateral portion, wherein a cavity is defined within each lateral portion;

a locking member rotatable between a first position and a second position, the locking member including a flange protruding perpendicularly from the locking member, wherein the locking member is configured to extend through an opening defined in an exterior wall of each lateral portion, and further wherein the flange is positioned within the cavity when the locking member is in the second position;

a cover secured to the locking member and the substrate, wherein the cover inhibits rotation of the locking member; and a rotatable member coupled to the locking member and configured to move said bin assembly between a stowed position and a deployed position.

2. The bin assembly of claim 1, wherein the locking member is disposed in the first position within the opening, and further wherein the locking member is engaged with the exterior wall when the locking member is rotated from the first position to the second position.

3. The bin assembly of claim 2, wherein the opening is further defined by a rim configured to prevent the locking member from rotating beyond the second position.

4. The bin assembly of claim 2, wherein the flange is positioned between the exterior wall and a dividing wall when the locking member is in the second position, the dividing wall extending into the cavity.

5. The bin assembly of claim 1, wherein the rotatable member includes a wheel and an axle.

6. The bin assembly of claim 5, wherein the axle is operably coupled to an aperture defined by the locking member, the aperture further extending through the cover and the substrate.

7. The bin assembly of claim 5, wherein the axle is integrally formed with the locking member.

8. A bin assembly comprising:

a substrate having a bottom surface and a perimeter wall defining a compartment with a front portion and a back portion, the substrate further defining a cavity and an opening;

a locking member having a center portion and two protrusions, the two protrusions extending in opposing directions from the center portion, and a flange extending from the locking member and perpendicularly to the center portion;

a cover securing the locking member and the two protrusions to prevent the locking member from rotating; and a wheel operably coupled with an axle that extends into an aperture defined by the locking member.

9. The bin assembly of claim 8, wherein the bottom surface and the perimeter wall are integrally formed, and wherein a stepped surface is defined along a lateral portion of the back portion of the compartment.

10. The bin assembly of claim 8, wherein a dividing wall extends into the cavity.

11. The bin assembly of claim 8, wherein the locking member and the two protrusions are disposed in the opening and allow the locking member to rotate in a first direction.

12. The bin assembly of claim 11, wherein the opening is further defined by an at least one outer lip, the outer lip having a contact surface that defines a predefined magnitude of rotation for the locking member in the first direction when disposed within the opening.

13. The bin assembly of claim 11, wherein the cover is configured to prevent rotation of the locking member in a second direction, the second direction opposite the first direction.

14. The bin assembly of claim 8, wherein the axle is configured to extend through the aperture and into the cavity to operably couple the wheel to the locking member.

15. A bin assembly comprising:

a substrate defining a compartment and a cavity external to the compartment;

a locking member rotatable between first and second positions, the locking member having a flange extending therefrom, wherein the locking member is disposed within an opening defined by an exterior wall of the cavity, and further wherein the locking member is engaged with the substrate when the locking member is in the second position;

a cover coupled with the locking member on an opposing side of the substrate from the flange; and a rotatable member operably coupled with an aperture defined by the cover, the locking member, and the exterior wall of the cavity.

16. The bin assembly of claim 15, wherein the flange is positioned within the cavity when the locking member is in the second position.

17. The bin assembly of claim 16, wherein the cover is configured to couple with the substrate to inhibit rotation of the locking member, thereby securing the locking member in the second position.

18. The bin assembly of claim 15, wherein the rotatable member includes a wheel and an axle.

19. The bin assembly of claim 18, wherein the axle is integrally formed with the wheel.

20. The bin assembly of claim 15, wherein the locking member includes a first protrusion extending from a center portion of the locking member and a second protrusion extending from the center portion of the locking member, and further wherein the first protrusion is laterally opposed to the second protrusion.

* * * * *